US007186370B2

(12) United States Patent
Lundberg et al.

(10) Patent No.: US 7,186,370 B2
(45) Date of Patent: Mar. 6, 2007

(54) COPPER-BASE ALLOY AND ITS USE

(75) Inventors: Mats Lundberg, Sandviken (SE); Johan Hernblom, Sandviken (SE); Kenneth Göransson, Gävle (SE); Peter Szåkalos, Stockholm (SE)

(73) Assignee: Sandvik Intellectual Property AB, Sandviken (SE)

( * ) Notice: Subject to any disclaimer, the term of this patent is extended or adjusted under 35 U.S.C. 154(b) by 295 days.

(21) Appl. No.: 10/921,888

(22) Filed: Aug. 20, 2004

(65) Prior Publication Data

US 2005/0079091 A1 Apr. 14, 2005

(30) Foreign Application Priority Data

Aug. 28, 2003 (SE) ..... 0302319

(51) Int. Cl.
*C22C 9/01* (2006.01)
*C22C 9/00* (2006.01)

(52) U.S. Cl. ..... 420/489; 420/490; 420/492; 420/495; 420/469

(58) Field of Classification Search ..... None
See application file for complete search history.

(56) References Cited

U.S. PATENT DOCUMENTS 2,778,733 A * 1/1957 Frejacques ..... 420/489
4,071,359 A 1/1978 Cheskis et al.
5,207,821 A * 5/1993 Ikenoue et al. ..... 75/247
5,445,686 A * 8/1995 Ueshima et al. ..... 148/330
6,737,175 B2 5/2004 Ramanarayanan et al.
7,041,252 B2 * 5/2006 Szakalos et al. ..... 420/489
2004/0005239 A1 1/2004 Szakalos et al.
2005/0079378 A1 * 4/2005 Lundberg et al. ..... 428/674

(Continued)

FOREIGN PATENT DOCUMENTS

JP 02-118041 * 5/1990

(Continued)

OTHER PUBLICATIONS

"Phase Diagrams of Binary Alloy Systems", *Metals Handbook*, 8th Ed., vol. 8, Metallography, Structures and Phase Diagrams, American Society for Metals, Metals Park, Ohio, 1973, p. 259.

(Continued)

*Primary Examiner*—John J. Zimmerman
(74) *Attorney, Agent, or Firm*—Drinker Biddle & Reath LLP

(57) ABSTRACT

A copper-base alloy with increased melting point above 1000° C., which is resistant or immune to carburization, metal dusting and coking, resistant to oxidation at elevated temperatures. The alloy has the following composition (in weight-%): Al 4–15, Si 0.1–6, Mo 0.5–40, W 0–40, where the total of Mo and W do not exceed 40%, one or more of the group of Rare Earth Metals (REM), such as yttrium, hafnium, zirconium, lanthanum and/or cerium, up to 1.0 weight-% of each element or a total of maximum 3.0 weight-%, Cu balance and normally occurring alloying additions and impurities. A method for the alloy's production, and the alloy's use as construction components in CO-containing atmospheres, ammonia containing atmospheres, and/or hydrocarbon containing atmospheres or solid carbon containing processes, are also disclosed.

20 Claims, 1 Drawing Sheet

U.S. PATENT DOCUMENTS

2005/0173300 A1* 8/2005 Szakalos et al. ..... 208/47

FOREIGN PATENT DOCUMENTS

| | | | |
|---|---|---|---|
| JP | 02-166246 | * | 6/1990 |
| JP | 03-291343 | * | 12/1991 |
| JP | 10-158766 | * | 6/1998 |
| JP | 2001-240924 | | 9/2001 |
| WO | WO 03/072836 A1 | | 9/2003 |

OTHER PUBLICATIONS

Lundberg et al., U.S. Appl. No. 10/921,943, filed Aug. 20, 2004 entitled "Metal Dusting Resistant Product".

* cited by examiner

COPPER-BASE ALLOY AND ITS USE

RELATED APPLICATION DATA

This application is based on and claims priority under 37 U.S.C. § 119 to Swedish Application No. 0302319-9, filed Aug. 28, 2003, the entire contents of which are incorporated herein by reference.

FIELD OF THE DISCLOSURE

The present disclosure relates to a Cu-base alloy, which is resistant or immune to carburization, metal dusting, coking, and resistant to oxidation at elevated temperatures and a method for its production. The disclosure also relates to the use of said alloy in construction components in CO-containing atmospheres, and/or hydrocarbon-containing atmospheres or solid-carbon-containing processes or processes that contain ammonia and/or other reactive nitrogen-compounds as well as products formed from such alloys.

STATE OF THE ART

In the discussion of the state of the art that follows, reference is made to certain structures and/or methods. However, the following references should not be construed as an admission that these structures and/or methods constitute prior art. Applicant expressly reserves the right to demonstrate that such structures and/or methods do not qualify as prior art against the present invention.

The increasing demands on efficiency in the petrochemical industry lead to the development of new processes that require higher temperatures. These processes give rise to, e.g., carburization, metal dusting, coking, and oxidation. When exposed to increased temperatures, i.e., temperatures above approximately 700° C., presently used alloys are exposed for severe corrosion.

A possible solution for an alloy for use in environments that can give rise to the above-mentioned corrosion mechanisms is copper and its alloys. However, a strong limitation for the use of copper or its alloys is their low melting point.

SUMMARY

It is therefore an object of the invention to provide a copper-based alloy with an increased melting point, more specifically a copper-base alloy with a melting point above 1000° C.

It is another object of the invention to provide a method for the production of a copper-based alloy with a melting point above 1000° C.

It is another object of the invention to provide a copper-based alloy for use as construction components in CO-containing atmospheres, and/or hydrocarbon-containing atmospheres or solid-carbon-containing processes or processes that contain ammonia and/or other reactive nitrogen-compounds as well as products formed from such alloys. Examples include gasification of solid carbonaceous materials, thermal decomposition of hydrocarbons and catalytic reforming, particularly, catalytic reforming under low-sulfur, and low-sulfur and low-water conditions and alloys that are resistant to loss of material by copper vaporization, or in annealing using cracked ammonia as shielding gas.

An exemplary copper-base alloy having a melting point of at least 1000° C. has a composition comprising, in weight-% (wt-%): Al 4 to 15; Si 0.1 to 6; Mo 0.5 to 40; W 0 to 40, wherein the total of Mo and W does not exceed 40 wt-%; one or more Rare Earth Metals in an amount up to 1.0 wt-% of each Rare Earth Metal or a total amount of Rare Earth Metals of a maximum 3.0 wt-%; Cu balance; and normally occurring alloying additions and impurities.

An exemplary method of producing a copper-base alloy comprises alloying a Cu—4 to 15 wt-% Al-alloy with 0.5–40 wt-% Mo and/or 0–40 wt-% W, wherein a total of Mo and W does not exceed 40 wt-%.

BRIEF DESCRIPTION OF THE DRAWING FIGURES

The following detailed description of preferred embodiments can be read in connection with the accompanying drawings in which like numerals designate like elements and in which.

DETAILED DESCRIPTION

Figure 1:
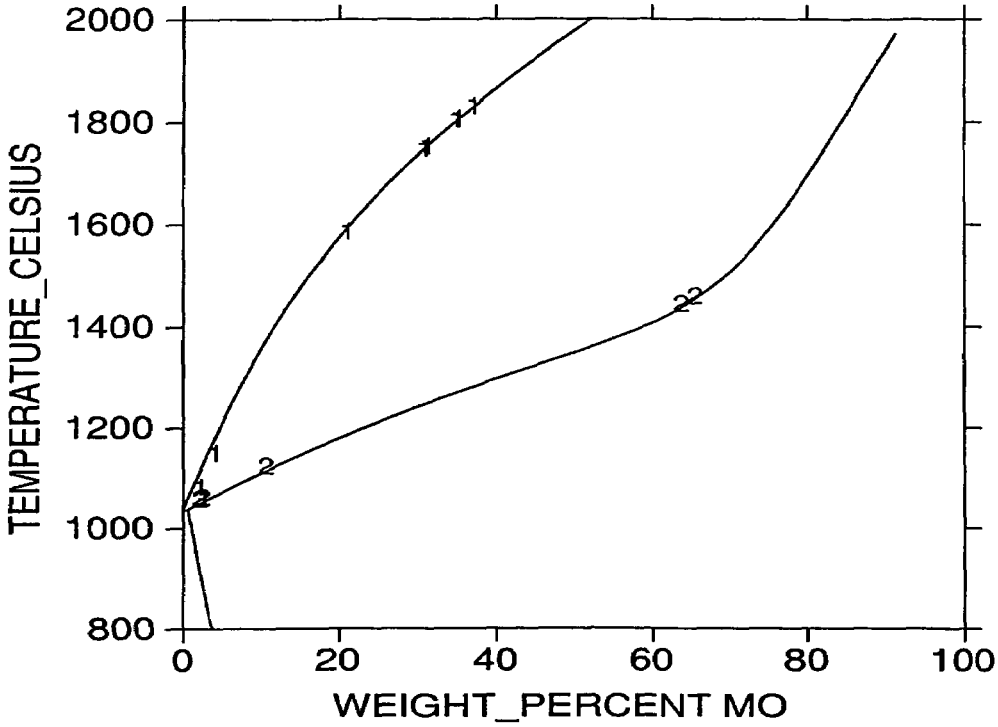
FIG. 1 shows the liquidus temperature (1) and solidus temperature (2) as a function of the molybdenum content for a Cu—8.7Al bronze, which in the pure Cu—Al-system is called β.

These objects are fulfilled with an alloy as described in the following having the following composition (in weight-%):

Al 4–15,

Si 0.1–6,

Mo 0.5–40,

W 0–40, where the total of Mo and W does not exceed 40 wt-%, one or more of the group of Rare Earth Metals (REM), such as yttrium, hafnium, zirconium, lanthanum and/or cerium, up to 1.0 weight-% of each element, or a total of maximum 3.0 weight-%, Cu balance, and normally occurring alloying additions and impurities.

Below, the effects of different alloying elements in the corrosion resistant alloy are described and specified.

Aluminum: Aluminum should be added for its capacity to form a protective alumina layer on the surface of the alloy in the temperature range of 300° C. to 1300° C. even in environments that solely contain trace of oxygen. Aluminum should be added in an amount up to 15 weight-%, preferably up to 13 weight-%, but not less than 4 weight-%.

Silicon: Silicon can be used in order to promote the protective effect of aluminum in this type of alloy by forming aluminum silicate, which has a higher formation rate compared to that of pure alumina. In this type of alloy the lower starting temperature for the formation of a protective oxide is favorable. Therefore silicon can be added to the alloy in order to improve the oxide formation at low temperatures. Thus, it is especially favorable for material which should be used in the temperature range of 300–900° C. to be alloyed with silicon in a content of up to 6 weight-%, preferably up to 4 weight-%, most preferably between 1.5 weight-% and 4 weight-%, and not less than 0.1%. If the alloy will be used at temperatures above 900° C., the content of silicon is favorable for the oxidation resistance, but also an alloy which does not contain silicon, forms protective alumina and therefore the content of silicon should be up to 6 weight-%, preferably 0.1–3 weight-%.

Nickel, Iron, Cobalt and Manganese: Transition metals, especially iron, nickel and cobalt, are known to have a strong catalytic effect on the formation of coke. The protecting capacity of the alumina layer, which will be formed on the surface of the alloy, however, allows that proportionately high levels of these elements could be permitted, but not more than a total of 5 weight-% of iron, manganese, nickel and cobalt.

Molybdenum: Molybdenum can be used to stabilize the high temperature beta-phase (β-phase) in an aluminum-bronze to improve its mechanical strength at increased temperatures from approximately 600° C. and increases respectively raises the melting point up to 1300° C., depending on the molybdenum content. Dependent on the content of Al, a pure Cu—Al-alloy with the Al-content in the preferred range as mentioned above has a melting point between 1040° and 1070° C. Therefore, a Cu-based aluminum bronze in the beta phase containing 0.5 to 40 weight-% of molybdenum will have a melting point between 1040° C. to 1300° C., depending on the molybdenum and the aluminum content. In order to increase the melting point of the alloy-system a molybdenum addition of, e.g., 10 wt-%, will give a melting point of 1100° C., while an addition of molybdenum of, e.g., 22 wt-%, will increase the melting point of a beta phase aluminum-bronze up to 1200° C., while an addition of molybdenum of, e.g., 40 wt-%, will result in a melting point of 1300° C. Molybdenum can partially or completely be replaced by tungsten. The total of Mo+W should not exceed 40 wt-%.

Tungsten: In this alloy system, tungsten has similar properties as molybdenum, in the sense that it would stabilize the beta-phase and, thus, increase the melting point of the alloy. However, tungsten can replace molybdenum, even though its stabilizing effect is somewhat weaker. It could therefore be added in a content of 0 to 40 wt-%. The total of Mo+W should not exceed 40 wt-%.

Reactive Additions: In order to further increase the oxidation resistance at higher temperatures, a certain amount of reactive elements, such as Rare Earth Metals (REM), e.g., yttrium, hafnium, zirconium, lanthanum and/or cerium, can be added. One or more of this group of elements should be added in an amount not exceeding 1.0 weight-% per element preferably not exceeding 0.3 weight-% per element. The total content of those elements should not exceed 3.0 weight-%, preferably not exceed 0.5 weight-%.

Copper: The main component, which amounts to the balance of the alloy of the present invention, is copper. Previously it has not been possible to use copper or copper rich alloys in applications facing higher temperatures (>200° C.), due to its high oxidation rate when in contact with oxygen rich atmospheres. The present alloy will form a protective aluminum oxide at elevated temperatures in oxygen containing atmospheres. Copper is known, to be resistant or immune to catalytic activity and coking, and therefore, the copper content should be kept as high as possible. The alloy comprises up to 96 weight-% Cu, but at least 38 weight-% Cu, preferably at least 47 weight-%, most preferably at least 63 weight-% Cu. It is clear to the person skilled in the art that a substitution of some of the Cu for Zn will only result in minor property changes for the alloy.

Further, the alloy comprises normally occurring alloying additions and impurities. These are defined as follows:

Alloying additions: Elements can optionally be added for process metallurgical reasons, for example, added in order to obtain melt purification from, e.g., S or O, or added in order to improve the workability of the cast material. Examples of such elements are B, Ca, and Mg. In order for such elements not to have a harmful effect on the properties of the alloy, the levels of each individual element should be less than 0.1%. In addition, several of the elements previously mentioned, e.g., Al, Si, Ce, Fe and Mn can also be added for process metallurgical or hot workability reasons. The allowable concentrations of these elements are as defined in the previous sections.

Impurities: Impurities refer to unwanted additions of elements from contaminants in the scrap metal used for melting or contamination from process equipment.

In some exemplary embodiments, the present alloy can be produced by alloying a Cu—Al alloy with Mo and/or W in the herein-described way and with the above-described contents of said elements.

In some exemplary embodiments, the present alloy can be used as construction components in CO-containing atmospheres, and/or hydrocarbon-containing atmospheres or solid-carbon-containing processes or processes that contain ammonia and/or other reactive nitrogen-compounds as well as products formed from such alloys. Examples of such high temperature processes are: steam reforming of natural gas, steam cracking of hydrocarbons to produce, e.g., ethylene and propylene, annealing processes where cracked ammonia is used as shielding gas.

Some exemplary embodiments of the present alloy can be machined to construction material in the shape of tubes, pipes, plates, strip and wire or be used in the shape of coating on one or more surfaces of other commonly used construction materials in said shapes.

EXAMPLE 1

Coke formation at 1000° C. in 83 vol-% CO+17 vol-% $H_2$: A laboratory exposure was performed in a tube furnace in a highly carbirizing atmosphere. The relative tendency to coke formation at 1000° C. was evaluated between a standard grade stainless steel and several Cu-base alloys. The chemical compositions of the materials investigated are give in Table 1.

Table 1 shows the chemical composition of the investigated materals, where Alloy 800 HT is a comparative example. The examples 2 to 7 are Cu-based materials according to the present invention. All contents are given in wt-%.

TABLE 1

| Example No. | Cr | Ni | Fe | Mo | N | Si | Mn | Co | REM | Ti | Al | Cu |
|---|---|---|---|---|---|---|---|---|---|---|---|---|
| Alloy 800HT | 20.4 | 30.10 | | 0.05 | 0.009 | 0.73 | 0.53 | | | 0.5 | 0.5 | <0.5 |
| 2 | | 0.5 | 3.5 | | | | | | | | 10.5 | Bal. |
| 3 | | | | 1.1 | | | | | | | 10.2 | Bal. |
| 4 | | | | 4.9 | | | | | | | 8.8 | Bal. |
| 5 | | | | | | 2.1 | | | | | 8.1 | Bal. |

TABLE 1-continued

| Example No. | Cr | Ni | Fe | Mo | N | Si | Mn | Co | REM | Ti | Al | Cu |
|---|---|---|---|---|---|---|---|---|---|---|---|---|
| 6 | | 0.021 | | | | 0.022 | 0.012 | | 0.075 | | 12.2 | Bal. |
| 7 | | | | | | — | | 4.95 | <0.01 | | 9.6 | Bal. |

The test material was taken from cast material and cut into rectangular shape with dimensions of approximately 10×15×3 mm and finally prepared by grinding to 600 mesh. Prior to testing, specimens were cleaned in acetone and then placed in the cold furnace. In order to reach a low oxygen partial pressure, pure hydrogen was flushed through the furnace for three hours before introducing the reaction gas and heating to test temperature. The laboratory exposure was conducted at 1000° C./100 h in a quartz tube furnace with a diameter of 25 mm. The gas flow rate was 250 ml/mm, which corresponds to a gas velocity over the specimen of 9 mm/s. The temperature was stabilized at 1000° C. after 30 minutes heating. The reaction gas had an input composition of 83 vol-% CO+17 vol-% $H_2$.

The results are presented in Table 2, which shows the weight gain sure to coke/graphite formation at 1000° C. on the surface of the specimen after 100 h. As comparative example, a specimen of Alloy 8000 HT was tested.

TABLE 2

| | Material | Coke formation at 1000° C.: [mg/cm$^2$/100 h] |
|---|---|---|
| 1 | Alloy 800HT | 5.2 |
| 2 | Cu—10.5Al—3.5Fe | 1.0 |
| 3 | Cu—10Al—1Mo | 0.3 |
| 4 | Cu—9Al—5Mo | 0.3 |
| 5 | Cu—8Al—2Si | 0 |
| 6 | Cu—12Al—Si—La | 0 |
| 7 | Cu—10Al—5Co | 0.5 |

As shown in Table 2, the CuAlSi alloys, e.g., alloy 5 and 6, do not show any coke formation, which could be detected by the naked eye, but these type of alloys are restricted to moderate temperatures due to their low melting points (<960° C.). The molybdenum alloyed aluminum bronzes have higher melting points, maintaining a low coking rate compared to commercial steel alloys, such as Alloy 800 HT.

EXAMPLE 2

An optional load carrier can be used at elevated temperatures, i.e. temperatures above approximately 400° C. For this purpose, the alloy can be machined to a component in a composite or bimetallic composite solution, which will be used as construction material in the different shapes as mentioned above. The later is especially valid if the alloy has low contents of molybdenum and tungsten. In the compositions with high molybdenum and/or tungsten contents, the highest temperature where the alloy can be used without any load carrier is considerably higher.

The alloy according to the present invention can be machined to construction material in the shape of tubes, pipes, plate, strip and wire.

If so required, a stronger alloy can be produced in the shape of tubes or plate or strip, where the load-carrying alloy is coated on one or more surfaces with the alloy according to the present invention. Some of the methods that can be used to produce a composite solution of the alloy and a load carrier are co-extrusion, co-welding or co-drawing and shrinkage of one tube on the load carrying component and one outer and/or inner tube of the alloy according to the invention, possibly followed by a heat treatment in order to obtain a metallurgical binding between the components. A similar method for the production of plate or strip is to hot- or cold-roll two or more plates or strips together. Composite plates or tubes can also be produced by explosion welding of two or more different plates or tubes of a load carrier and the alloy according to the invention. An outer- and/or inner-component can also be applied on a load carrier by help of a powder metallurgical technique, such as HIP (Hot Isostatic Pressing) or CIP (Cold Isostatic Pressing). In these cases the load carrier could be in the shape of tubes, pipes, plate, strip or wire or other suitable product form. After pressing, the formed composite can be further machined by, e.g., hot extrusion and/or welding, drawing and forging.

Other methods for the production of composite material are gas phase deposition of copper, aluminum, molybdenum and/or tungsten by, e.g., vaporization, pack cementation, sputtering, chemical vapor deposition (CVD), physical vapor deposition (PVD) or other methods. Aluminum-molybdenum bronze can also be deposited on the load carrier, e.g., by dipping in a melt or by overlay welding. These methods are possible to use in order to produce all of the above-mentioned product forms. Different coating methods can be used in order to supply copper, molybdenum and aluminum to the alloy. In such cases, a final heat-treatment is required in order to homogenize the alloy with the purpose to keep its corrosion properties.

Composite strip or composite plates, produced as above described, can be welded together to longitudinal welded or helical welded composite tubes with the alloy according to the invention on the inner and/or outside of the tube.

Suitable load carriers in the above mentioned product forms are such high temperature alloys, which today are used in the actual temperature range. This concerns, for temperatures lower than 700° C., martensitic or bainitic or ferritic iron alloys with additions of, e.g., chromium, molybdenum, vanadium, niobium, tungsten, carbon and/or nitrogen, in order to obtain mechanical strength at high temperature. At temperatures above approximately 500° C., it is usual to use austenitic iron-chromium-nickel alloys, which are possibly mechanically strengthened as load carrier by alloying with, e.g., molybdenum, vanadium, niobium, tungsten, carbon and/or nitrogen. In both of those groups of alloys, chromium and sometimes aluminium and/or silicon are used in order to give the load carrier an improved corrosion resistance. In those cases where the alloy according to the invention is deposited on both surfaces of such load carrier, the alloy according to the invention will deliver the corrosion resistance that is required. But that means, alloys whose maximum temperature of use in other applications is limited by the corrosion resistance being able to be used as load carriers at higher temperatures than otherwise. In those cases where the alloy according to the invention is only deposited at one surface of the load carrier, it is necessary that the load carrier itself has a sufficient corrosion resistance in the environment its untreated surface is exposed for.

EXAMPLE 3

Figure 2:
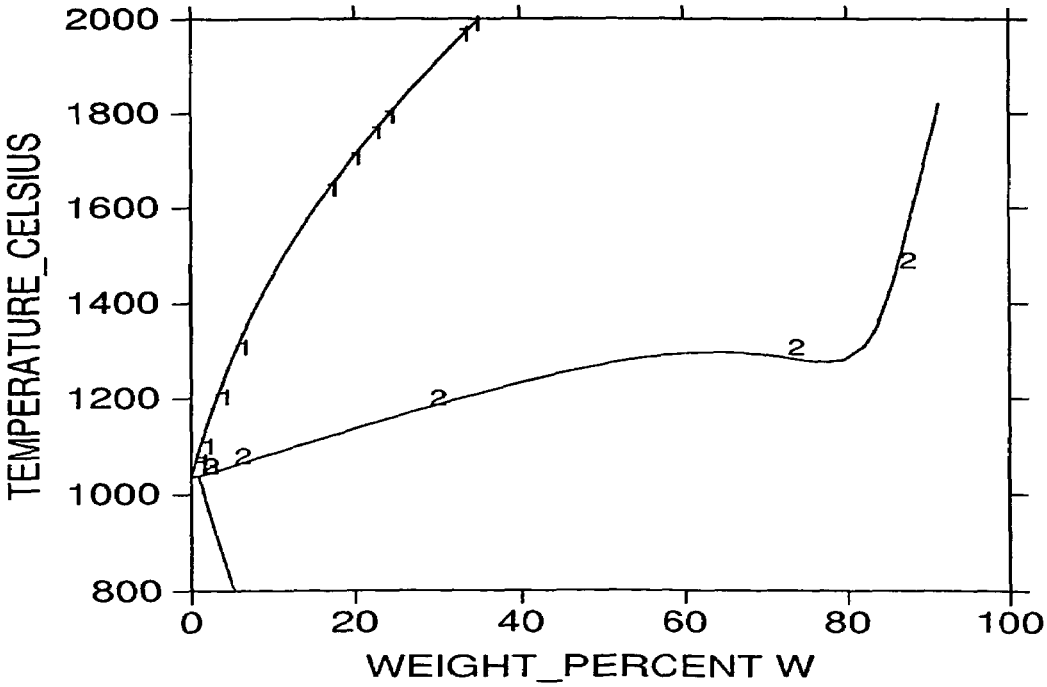
FIG. 2 shows the liquidus temperature (1) and solidus temperature (2) as a function of the tungsten content for a Cu—8.7Al bronze, which in the pure Cu—Al-system is called β.

In FIG. 1, a section of a phase diagram for the system Cu—Mo—W—Al calculated with Thermo-calc for a given Al-content of 8.7% is presented. FIG. 1 shows the solidus/liquidus temperatures calculated as a function of the content of molybdenum. FIG. 2 shows the solidus/liquidus temperatures calculated as a function of tungsten content. It is clear from the figures that Mo and W partly or completely can replace each other in the alloy, regarding the effects on the melting point of the alloy.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A copper-base alloy having a melting point of at least 1000° C. and a composition comprising, in weight-%:

Al 4–15;

Si 0.1–6;

Mo 10–40;

W 0–40, wherein the total of Mo and W does not exceed 40 weight-%;

one or more elements selected from the group consisting of Rare Earth Metals, hafnium and zirconium in an amount up to 1.0 weight-% of each element or a total amount of a maximum 3.0 weight-%;

Cu balance; and normally occurring alloying additions and impurities, wherein the melting point is at least 1100° C.

2. The copper-base alloy according to claim 1, wherein the melting point is at least 1200° C. and the composition comprises in weight-%: Mo 22–40.

3. The copper-base alloy according to claim 2, wherein the melting point is at least 1300° C. and the composition comprises, in weight-%: Mo 40.

4. The copper-base alloy according to claims 1, 2 or 3, wherein the composition comprises 4–13 weight-% Al.

5. The copper-base alloy according to claim 4, wherein the composition comprises 1.5 to 3 weight-% Si.

6. The copper-base alloy according to claim 1, wherein said alloy is resistant to oxidation in CO— and/or $H_2O$ -containing atmospheres, and/or hydrocarbon containing atmospheres or solid-carbon-containing processes.

7. The copper-base alloy according to claim 6, wherein the solid-carbon-containing processes include gasification of solid carbonaceous materials, thermal decomposition of hydrocarbons or catalytic reforming.

8. The copper-base alloy according to claim 7, wherein catalytic reforming includes catalytic reforming under low-sulfur conditions or catalytic reforming under low-sulfur and low-water conditions.

9. The copper-base alloy according to claim 1, wherein the one or more elements selected from the group consisting of Rare Earth Metals, hafnium and zirconium is one or more of yttrium, hafnium, zirconium, lanthanum and cerium.

10. The copper-base alloy according to claim 1, wherein the one or more elements selected from the group consisting of Rare Earth Metals, hafnium and zirconium is present in an amount up to 0.3 weight-% of each.

11. A composite material comprising the copper-base alloy according to claims 1, 2 or 3.

12. An article of manufacture in the form of a tube, pipe, plate, strip or wire, the article is formed at least in part from the alloy according to claim 1.

13. A method of preventing metal dusting and coking of metal articles in environments containing CO and/or hydrocarbons and in solid carbon-containing processes, the method comprising forming a metal article at least in part from the alloy according to claim 1 and introducing the metal article into an environment containing CO or hydrocarbons or into an environment of a solid carbon-containing process.

14. The method according to claim 13, further comprising providing the metal article in the form of a tube, pipe, strip or wire.

15. The method according to claim 13, wherein a temperature of the environment is above 1000° C.

16. The method according to claim 15, wherein the environment includes catalytic reforming under low-sulfur conditions or catalytic reforming under low-sulfur and low-water conditions.

17. A method of producing a copper-base alloy with a melting point above 1000° C., the method comprising:

alloying a Cu—4–15 wt-% Al-alloy with 10–40 wt-% Mo and 0–40 wt-% W, wherein a total of Mo and W does not exceed 40 wt-%.

18. The copper-base alloy according to claim 1, wherein said alloy is resistant to nitration in reactive nitrogen compound-containing processes.

19. A method of preventing corrosion in reactive nitrogen compound-containing processes, the method comprising forming a metal article at least in part from the alloy according to claim 1 and introducing the metal article into an environment containing a reactive nitrogen compound or into an environment of a reactive nitrogen compound-containing process.

20. The method according to claim 19, further comprising providing the metal article in the form of a tube, pipe, strip or wire.

* * * * *